United States Patent [19]

Koblitz et al.

[11] Patent Number: 5,004,869

[45] **Date of Patent: * Apr. 2, 1991**

[54] ELECTRICAL CONNECTOR CONTAINING ADIPIC ACID POLYESTER SEALANT COMPOSITION

[75] Inventors: Francis F. Koblitz; Thomas M. O'Shea, both of York; Beverly A. Stoner, Glen Rock; Joseph J. Yula, York, all of Pa.

[73] Assignee: AMP, Incorporated, Harrisburg, Pa.

[ * ] Notice: The portion of the term of this patent subsequent to Dec. 22, 2004 has been disclaimed.

[21] Appl. No.: 136,143

[22] Filed: Dec. 21, 1987

Related U.S. Application Data

[63] Continuation-in-part of Ser. No. 767,566, Aug. 20, 1985, Pat. No. 4,714,801, which is a continuation of Ser. No. 620,411, Jun. 14, 1984, abandoned.

[51] Int. Cl.[5] ..... H01R 4/20

[52] U.S. Cl. ..... 174/84 C; 524/602; 524/604

[58] Field of Search ..... 174/88 R, 84 C; 523/122; 524/247, 386, 387, 604, 602

[56] References Cited

U.S. PATENT DOCUMENTS

| | | | |
|---|---|---|---|
| 2,528,606 | 11/1950 | Pederson | 524/247 |
| 2,662,067 | 12/1953 | Legs et al. | 524/386 |
| 2,852,484 | 9/1958 | New | 524/386 |
| 3,410,950 | 11/1968 | Freudenberg | 174/84 |
| 3,875,323 | 4/1975 | Bopp et al. | 174/23 C |
| 4,063,002 | 12/1977 | Wilson, Jr. | 524/59 |
| 4,180,652 | 12/1979 | Nogami et al. | 525/437 |
| 4,209,438 | 6/1980 | Okada et al. | 524/314 |
| 4,318,843 | 3/1982 | Köhler et al. | 524/247 |
| 4,405,729 | 9/1983 | Schweitzer | 523/466 |
| 4,456,718 | 6/1984 | Brinkmann et al. | 525/457 |
| 4,683,190 | 7/1987 | Sondergeld et al. | 524/247 |
| 4,714,801 | 12/1987 | Koblitz et al. | 174/88 R |

OTHER PUBLICATIONS

Damusis, *Sealants*, Reihold Publishing Corp., New York, N.Y., 1967, pp. 116–169.

Iler, *The Colloid Chemistry of Silica and Silicates*, Cornell University Press, Ithaca, N.Y., 1955, pp. 169 and 170.

*Primary Examiner*—John C. Bleutge

*Assistant Examiner*—Robert E. L. Sellers, II

*Attorney, Agent, or Firm*—Woodcock Washburn Kurtz Mackiewicz & Norris

[57] ABSTRACT

A sealant material that is relatively chemically inert toward plastics and adhesives is comprised of a homogeneous mixture of polymeric polyester, said polyester being derived from adipic acid, and silica, the polyester comprising more than about 50 percent by weight of the mixture and the fumed silica comprising less than about 20 percent by weight of the mixture. In a preferred embodiment, the sealant material further contains an organofunctional silane coupling agent, a polyfunctional bridging agent, a dispersing agent and a fluorosurfactant.

20 Claims, 1 Drawing Sheet

ELECTRICAL CONNECTOR CONTAINING ADIPIC ACID POLYESTER SEALANT COMPOSITION

The present application is a continuation-in-part of application Ser. No. 767,566, filed Aug. 20, 1985, now U.S. Pat. No. 4,714,801, which is in turn a continuation of application Ser. No. 620,411, filed June 14, 1984, now abandoned, both of which are assigned to the assignee of the present invention and incorporated herein by reference.

The present invention relates to sealant compositions, electrical connectors including said sealant compositions, and methods of making same. More particularly, this invention relates to sealant compositions resistant to water diffusivity and weather resistant connectors containing these compositions.

The quality and durability of electrical connections are important factors in the design of electrical systems, especially electrical systems utilized in the telecommunications industry. The quality of electrical connections is determined not only by the extent of effective electrical insulation surrounding the connection, but also the extent to which the actual connection is maintained in a moisture-free, non-corrosive environment. The existence of water at the connection site is detrimental in several respects. For example, the "crosstalk" which frequently plagues telecommunication systems is sometimes caused by moisture in the connections which provides a path for signal leakage. The presence of water also has the obvious disadvantage of fostering corrosion thus negatively impacting upon the durability of the connection. The ability of the connecting material and/or apparatus to withstand degradation in the face of environmental variations, for example, temperature cycling, also has an impact upon connection durability. A faulty connection, especially in telecommunication systems, may be expensive and time consuming to repair or replace because of inaccessibility and difficulty of identification.

Various sealant compositions have been used in electrical connectors to form sealed connections. For example, U.S. Pat. No. 3,410,950-Freudenberg, which is incorporated herein by reference, discloses open U-type or channel-type connecting devices having a sealant system. The pre-insulated connector disclosed therein has one insulating film surrounding the outside of the open U-type ferrule, the ferrule having one or more wire receiving projections on its inside surface. Sealing material is contained between the inside insulating film and the surface of the ferrule adjoining the projections. When the connector is crimped onto wires, the projections rupture the inside film layer permitting the sealing material to flow around the wires. Impregnated polyurethane foams are described as the preferred sealant material, although flowable plastic materials are mentioned as alternatives.

The sealants used with connectors of the type described above frequently have a silicone base. Although sealants of this type do repel moisture, they also have a tendency over a period of time to creep out of the connector. Their oil base has been observed to separate and to "cream" or "bleed" during storage. Furthermore, fractions of the silicone based sealants have significant vapor pressures under common ambient conditions. Fractions of the sealant, therefore, vaporize when exposed to the atmosphere and condense on nearby surfaces including switch gear contacts resulting in accelerated arcing and corrosion.

The sealant material disclosed herein has dielectric properties similar to those of silicone based sealants. The problems described above, however, are greatly reduced. The compositions of the present invention have lower water and oxygen diffusivity than silicone based sealants. The sealants generally have higher viscosities, thus greatly reducing the problem of migration, that is, creeping and extraction. The lower vapor pressures of the herein disclosed sealants greatly decrease the problem of contamination of the surrounding area.

Accordingly, it is an object of the present invention to provide sealant compositions and sealed electrical connectors which are resistant to the passage of water.

It is a further object of the present invention to provide sealant compositions and sealed electrical connections which are resistant to the passage of oxygen.

It is yet another object of the present invention to provide sealant compositions whose properties, including water sorption and viscosity, are relatively constant over a wide range of temperatures.

It is a still further object of this invention to provide sealant compositions which are resistant to creep and extraction caused by exogenous agents such as water and heat.

It is an additional object of the present invention to provide sealant compositions and sealed electrical connectors having little or no inherent tendency to cause corrosion at the connection or in the area surrounding the connection.

These and other objects of the present invention are generally satisfied by sealant compositions comprising adipic acid derived polymeric polyesters and silica. The sealant compositions of the present invention also preferably include a bridging agent to promote gelation of the compositions and stability of the gel structure. According to certain embodiments of the present invention, the mixture further comprises wetting or dispersing agents for promoting dispersion and homogenization of the silica. A surfactant may also be included in certain embodiments to promote wetting and dispersion of the silica. The compositions may also optionally include antimicrobial agents, corrosion inhibitors and/or antioxidants.

The objects of the present invention are also generally satisfied by connectors which incorporate the compositions of the present invention. According to one preferred embodiment, the connector includes a receiving means for accepting and receiving a transmission means. The transmission means provides means for transmitting electrical current or signals, such as an electrical wire. A sealant according to the present invention is disposed within or adjacent to the wire receiving means, the sealant being substantially flowable but substantially non-migratory under crimping pressure.

The objects of the present invention are also generally satisfied by methods of manufacturing electrical connectors which incorporate the compositions of the present invention. According to one preferred embodiment, the manufacturing methods require providing a connector body having a receiving means for accepting and receiving a transmission means. The methods further require dispensing a sealant according to the present invention into said connector body.

DESCRIPTION OF THE DRAWINGS

FIG. 1 shows a typical channel type connector body 10 which uses a sealing material 12. Connector 10 is comprised of an outer insulating film 14, an open U-type metal ferrule 16 having a plurality of wire receiving projections 18 extending from inner surface 16A of ferrule 16. Sealing material 12 is dispensed into the connector body 10, and in this particular embodiment it is deposited on the ferrule 16, particularly in the areas of projections 18. Connector 10 further has an inner insulating film layer 20 therein which extends over the sealant 12, and projections 18. Film layer 20 is sealed usually by means of heat to the sides of the ferrule 16 thus encasing the sealant material. In using the connector 10, means for transmitting electrical current or signals, such as wires 22 are inserted from opposite ends of the connector 10 and disposed in the area of projections 18. As is shown in FIGS. 1 and 2 the wires 22 lie on top of inner film layer 20. FIG. 3 shows a cross section of the crimped connector 10. Crimping of connector 10 generally requires exertion of force on the sidewalls 16B of the ferrule 16 sufficient to deform the ferrule into a position similar to the one shown in FIG. 3, thereby forcing the wires 22 into receiving slots 24 in projections 18. For the purpose of convenience, the force required to produce such a deformation is referred to herein as the normal crimping force. As will be understood by those skilled in the art, the magnitude of this force will vary somewhat depending upon several factors, including connector design and size. During the crimping of the connector 10, wires 22 rupture the film layer 20 as they are forced into receiving slots 24 in projections 18. As a result of the pressure exerted by the normal crimping force, sealant 12 flows through the breach in the film layer 20 and surrounds the intersections of the wires and the projections thereby sealing the immediate contact areas between the wires and connector.

Figure 1:
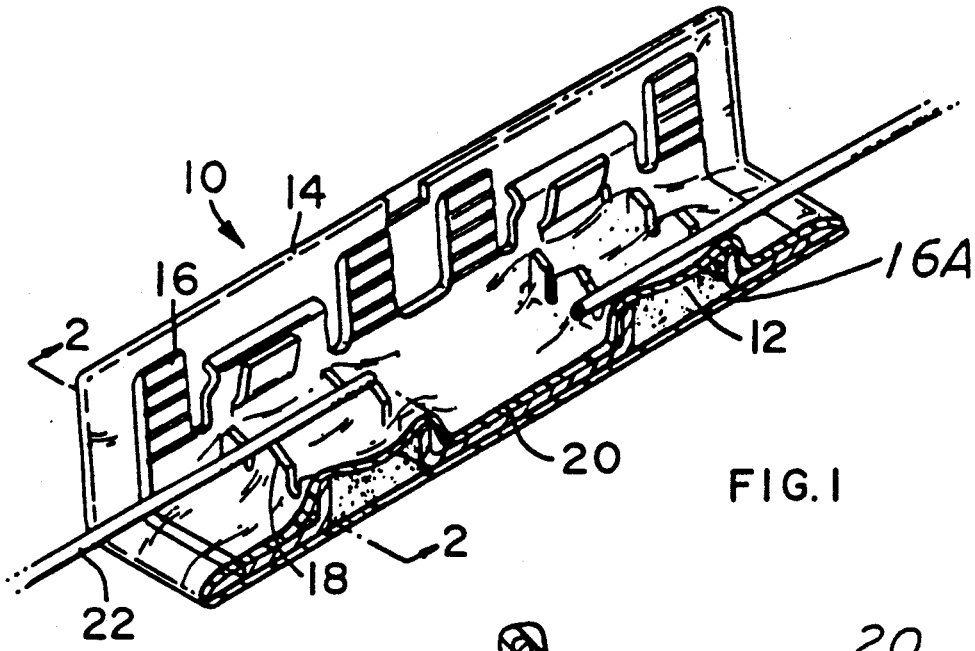
FIG. 1 is a longitudinal sectional perspective view of an uncrimped connecting device according to one embodiment of the present invention having sealant therein.
Figure 2:
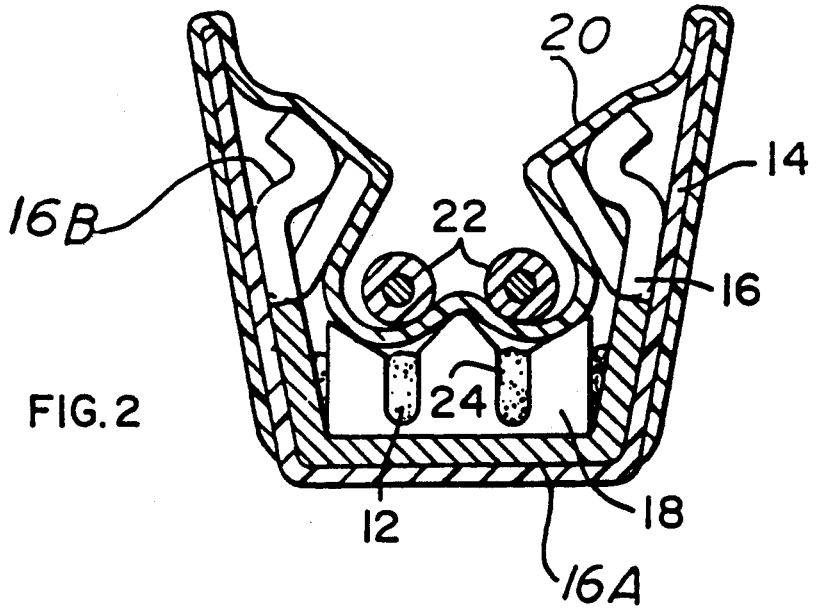
FIG. 2 is a cross sectional view taken along lines 2—2 of the device in FIG. 1 showing the location of the sealant with respect to the wires.
Figure 3:
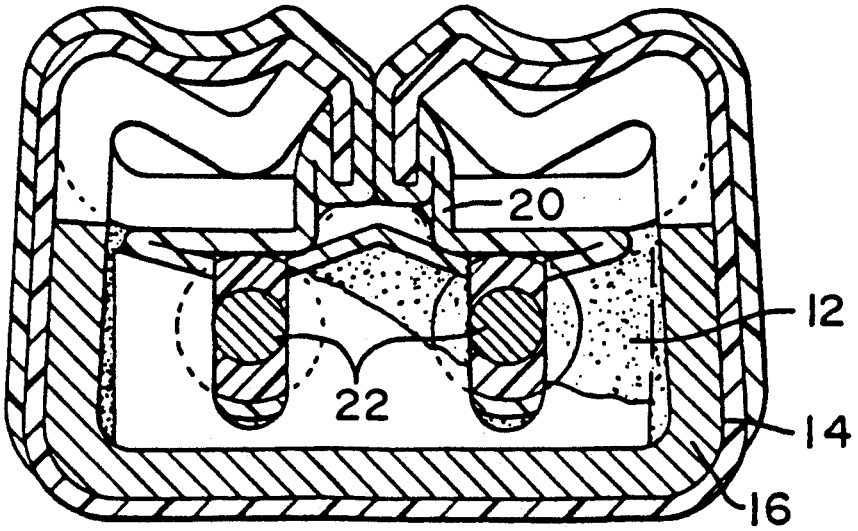
FIG. 3 is a view similar to FIG. 2 but showing the positions of the sealant and parts after crimping.

It is generally desirable for the sealants of the present invention, especially when used in the manner described above, to have certain physical and chemical properties. For example, the sealant is preferably chemically inert to the metal and plastic films that are used in the connector. It also is highly desirable that the sealant be sufficiently thixotropic to avoid flowing out of the connector during crimping and subsequent use in service. Thixotropy is known in the art as the property of various gels of becoming relatively fluid when agitated or disturbed and to return to the gel form at rest. At the same time, it is also desirable for the sealant to be capable of being flowed through a feeding means which dispenses measured amounts of the sealant to the connector during its manufacture. The rheology of the sealants also preferably allows the sealant to be easily separated from the dispenser without "stringing". Of course, the sealant preferably remains stable during the manufacture process; in particular, it is desirable for the sealant to remain stable while the inner film layer is being sealed to the connector.

One important aspect of the present invention resides in the particular physical characteristics of the compositions of the present invention, and in particular the gel-like structure that these materials generally possess. It is known that certain materials undergo a transition from a solution or stable suspension or dispersion to what is commonly called a "gel phase". While the exact nature and molecular structure of gel phase materials continues to be the subject of debate, gelling is thought to be the aggregation of particles in a solution or dispersion to form a stable three dimensional network. Silica gels are believed to result from interparticle bonding of low surface charge silica particles which come together to form silanol hydrogen bonds, thereby holding the particles together. In essence, the silica particles may be described as coalescing to form a stable gel phase. Additional information on the nature of silica gels is contained in the book by Ralph K. Iler, "The Chemistry of Silica Solubility, Polymerization, Colloidal and Surface Properties, and Biochemistry", J. Wiley and Sons, 1979, which is incorporated herein by reference.

Although applicant does not intend to be bound by or to any particular theory, the gelling nature of silica is believed to promote or perhaps even cause thickening of the present compositions to produce materials having a gel-like structure. Although this phenomenon is not thoroughly understood, for the purposes of the present invention it is sufficient to note that the gel-like structure of the compositions of the present invention is generally characterized by viscosities which are sufficiently high to inhibit creeping or extraction when the compositions are exposed to conditions of normal use. As is discussed more fully hereinafter, the compositions of the present invention are generally produced from solutions and/or stable homogeneous dispersions. The dispersions are generally mixed by stirring at elevated temperature until a relatively rapid increase in viscosity occurs. For the purposes of convenience, the point at which this increase occurs is herein designated as the "gel point". Methods are known in the art for determining the existence of a gel point and therefore the presence of a gel-like structure. For example, a common method of determining the "gel point" of a dispersion is to observe when the meniscus of the dispersion in a container no longer remains horizontal when the container is tilted.

The sealant compositions of the present invention generally comprise a major portion of polymeric polyester derived from adipic acid. Preferably, the polymeric polyester has a dielectric strength greater than about 200 v/mil, a solidification point of less than about 0° F., a volatility of less than about 1 percent per day at 194° F., and low water sorption. As the term is used herein, low water sorption means water sorption of less than about 2 percent (equilibrium at 68° F.). The molecular weight of the polymeric polyester is preferably from about 1,000 to about 8,000, more preferably from about 2,200 to about 6,000, and even more preferably from about 4,000 to about 5,000. Polyesters according to the present invention may generally be formed by the condensation reaction of a bifunctional carboxylic acid, preferably adipic acid, and a bifunctional alcohol, preferably lower alkylene glycols such as ethylene, propylene and butylene glycols and mixtures thereof, the more preferred polyols being 1,3 or 1,4-butylene glycol. Other glycols and mixed glycols can also be used, including those with functionally terminated side chains. Suitable polyesters are available from Emery Industries, Cincinnati, Ohio, under the trade name PLASTOLEIN 9776, and from the C. P. Hall Co., Chicago, Ill., under the trade names PLASTHALL P-644, PARAPLEX G-57 and PARAPLEX G-59. These are all characterized by their chemical inertness to plastic films and adhesives and their wide range of thermal stability and functionality.

The compositions of the present invention also generally include silica as a thickening agent. Although the inclusion of all classes and types of silica is within the scope of the present invention, applicants have found that certain classes of silica are particularly preferred. In particular, fumed silica, also sometimes called pyrogenic silica, is preferably used in the sealant compositions of the present invention. Many methods for producing fumed silicas are known in the art. For example, a common procedure known as flame hydrolysis requires the oxidation of silicon tetrachloride, usually by combustion with natural gas, to form hydrogen chloride and silicon dioxide vapor. The silicon dioxide is then condensed to a powder. The specific surface area of such flame-hydrolyzed silica is generally from about 200 to about 400 $m^2/g$. Other techniques for producing fumed silicas are also known to those skilled in the art. For example, finely divided fumed silica can be made by the reaction of dimethyldichlorosilane with silicon dioxide at about 500° C. It is also contemplated that precipitated silicas may be included in the compositions of the present invention since they are generally more hydrophilic than the fumed silicas and therefore more easily wet and/or dispersed; however, due to their relatively weak gelling and/or thickening properties, these materials are preferably only used in combination with fumed silicas. Exemplary precipitated silicas are sold under the trademarks "ZEOTHIX 177" and "ZEOTHIX 265", both products of the J. M. Huber Corporation. Exemplary silica including both fumed and precipitated silica may be a combination of "AEROSIL 200" or "AEROSIL R-972", which are fumed silicas sold by the Degussa Corporation and "ZEOTHIX 265" or "ZEOTHIX 177", which are precipitated silicas.

Fully hydrophobized silicas are included in certain embodiments of the compositions of the present invention. As the term is used herein, "fully hydrophobized silica" refers to those silicas which have undergone extensive hydrophobizing surface treatment. In particular, fully hydrophobized silicas have been surface treated to such an extent that essentially all surface silanol (—SiOH) groups are occupied or functionally blocked. Silicas having more than about 40 percent of the surface silanol groups occupied or functionally blocked are considered fully hydrophobized Methods for providing hydrophobic surface treatments are well known in the art, as illustrated at page 680 et. seq. in the Iler publication described above. According to certain embodiments of the present invention, therefore, the silica is preferably of the fully hydrophobized class since material of this class tends to enhance effective viscosity control and water repellency, and generally has a refractive index that functionally matches that of the polyester. Exemplary fully hydrophobized fumed silicas are available from Degussa Corp., Teterboro, N.J., under the trade name AEROSIL R-974, and from Tulco Corp., Ayer, Mass., under the trade name TULLANOX 500.

One method for producing the sealant compositions of the present invention comprises dispersing the silica in the polymeric polyester. One advantage of the hydrophobic silicas described above is that they are relatively easily dispersed in the polymeric base material. It would also be expected that the relative hydrophobicity of these silicas provide the additional benefit of augmenting the water repellent qualities of the composition. Although some slight benefit in this regard is believed to occur, applicants have surprisingly found that the water and oxygen repellent characteristics of the present sealant compositions are controlled predominantly by the polymeric material and that the silica primarily affects the thickening and/or gelling of the compositions, having only a relatively minor impact on the water and oxygen permeability of the compositions. Applicants have discovered that, surprisingly, hydrophilic silicas provide the present compositions with improved gelling characteristics, low inherent corrosion and excellent water repellency. The term hydrophilic silica is used herein in its relative sense and refers generally to those silicas which are not within the definition of fully hydrophobized silicas described above. More particularly, the term hydrophilic silica as used herein generally refers to those silicas which have undergone only relatively mild hydrophobizing surface treatment as well as those which have not undergone any hydrophobizing surface treatment. As is fully understood by those skilled in the art, the production of fully hydrophobized silica, and particularly fumed silicas of this class, generally creates either hydrogen chloride or ammonia byproducts which are difficult to remove from the silica, thus resulting in material which contains up to about 0.5 wt % HCl or ammonia. Thus, fully hydrophobized silicas generally have an inherent corrosivity which may negatively affect the durability of the connector in which it is used. This inherent corrosivity is not only undesirable in the connector itself, it also tends to cause corrosion of the equipment use to manufacture the present sealant compositions. Moreover, fully hydrophobized fumed silicas are generally more expensive than hydrophilic silicas, the difference in cost currently being on the order of about 20 percent.

Not only do the hydrophilic silicas of the present invention avoid the disadvantages described above, inclusion of these materials surprisingly provides compositions having water repellent capabilities comparable to those containing fully hydrophobized silicas. Moreover, hydrophilic silicas generally contain a larger proportion of silanol functionalities which are believed to enhance the gelling capacity of the silica and also its dispersability in the polymeric base material. Accordingly, hydrophilic fumed silicas are preferably included in the compositions of the present invention. Exemplary hydrophilic fumed silicas are sold under the trademarks "AEROSIL 200" by the Degussa Corp., Peteborro, N.J. and "CAB-O-SIL M-5" by the Cabot Corp., Cab-O-Sil Division, Tuscola, Ill.

The compositions of the present invention also preferably include bridging agents for promoting interparticle bonding between the dispersed silica particles. The sealant compositions of the present invention also preferably include coupling agents for promoting bonding between the polymeric polyester and the dispersed silica particles. Although it is believed that most well known coupling and bridging agents will perform in the present compositions with some degree of success, inorganic based coupling agents having at least one organic functional group and/or polyfunctional organic based bridging agents are included in preferred embodiments of the present invention.

With regard to inorganic based coupling agents, silane coupling agents, and especially dual reactivity organofunctional silanes, are preferred. While applicants do not intend to be bound by or to any particular theory, it is believed that the silane coupling agents of the present invention are capable of forming covalent bonds with both the organic and inorganic constituents of the present invention. In particular, hydrolyzable functional groups, such as chloro, alkoxy and acetoxy groups, contained in the preferred silanes are capable of forming silanols (—SiOH) which condense with similar groups contained in the silica. Accordingly, silane coupling agents of the present invention are especially effective when included in compositions which include hydrophilic silica since this material also contains a relatively large proportion of silanol functional groups. In a like manner, the organic functional groups contained in the preferred silanes of the present invention, such as vinyl, methacryloxy, glycidoxy, amino, epoxy or mercapto groups, are capable of reacting and bonding with the organic functionalities of the polymeric base material. A relatively large number of dual reactivity organofunctional silanes are known to those skilled in the art and all are within the scope of the present invention. However, the silane coupling agents of the present invention are even more preferably selected from the group consisting of (3-glycidoxypropyl)trimethoxysilane, hexamethyldisilazane, (3-methacryloxypropyl)trimethoxysilane (referred to as MPTS), (2-epoxycyclohexylethyl)trimethoxysilane, and mixtures of these, with the (3-glycidoxypropyl)trimethoxysilane being the most preferred. (3-glycidoxypropyl)trimethoxysilane is sold under the tradename "G6720" by Petrarch Systems Inc., Bristo, Pa. Hexamethyldisilazane is sold under the tradename "H7280" and (MPTS) is sold under the tradename "M8550" by Petrarch Systems Inc.

With regard to the organic bridging agents, it is preferred that these materials contain one or more functional groups which are capable of hydrogen bonding with structures contained in either the silica or polyester material, and preferably with both. Accordingly, preferred organic bridging agents are hydroxylated or amino-functional compounds, such as alcohols, glycols, multifunctional hydroxylated compounds and amines. Applicants have found that triethanolamine (referred to as TEA) is an especially preferred organic bridging agent. Although applicants do not intend to be bound by or to any particular theory, it is believed that TEA is an excellent bridging agent in the compositions of the present invention because its trifunctional molecular architecture enables it to hydrogen bond with at least one silica particle and with other substances in the present compositions. This promotes the formation of a relatively strong and stable gel structure, which in turn improves the above described desirable characteristics of the present invention. TEA is also preferred because it is believed that its relatively strong acid-base reactivity ($pk_a$ of approximately 12) aids in mitigating any inherent corrosivity of the silica. Accordingly, the organic bridging agents of the present invention are preferably selected from the group consisting of ethylene glycol, propylene glycol, pentaerythritol, trimethylolpropane, TEA, and mixtures of these, with TEA being the most preferred.

It will be appreciated by those skilled in the art that the amount of polymeric polyester contained in the compositions of the present invention will depend upon many factors, including the particular polymer used, the contemplated application, the extent of water repellency desired, and the amount and cost of other materials included in the composition. In general, however, it is preferred that compositions of the present invention contain more than about 50 weight percent polymeric polyester.

For the purpose of illustration only but not by way of limitation, the compositions of the present invention may be broadly categorized according to the type of silica they contain. Thus, sealant compositions in which the silica component comprises in major proportion a fully hydrophobized fumed silica are for the purpose of convenience also referred to as Class One compositions. On the other hand, compositions in which the silica comprises in major proportion a hydrophilic silica are hereinafter sometimes referred to as Class Two compositions. Although the sealant compositions of the present invention may certainly comprise mixtures of fully hydrophobized and hydrophilic silicas, applicants have found that certain component concentrations are preferred for predominantly Class One compositions, while somewhat different ranges are preferred for predominately Class Two compositions. In particular, applicants have found that when compositions of the present invention contain silicas which are comprised in major proportion of fully hydrophobized fumed silica, such compositions are preferably comprised of from about 80 percent to about 88 percent by weight polyester and from about 12 percent to about 18 percent by weight of silica. Moreover, Class One compositions generally do not require the coupling or bridging agents of the present invention for promoting and enhancing bonding between the dispersed silica particles, although such components may certainly be included. When coupling and/or bridging agents are included in Class One compositions, the concentration of silica is preferably about 13.5 weight percent of the composition since these materials tend to reduce the silica requirements. In either event, however, it is also generally preferred that Class One compositions include about 0.02 percent on a weight basis of an organofunctional silane to assist in the dispersion and homogenization of the silica and to increase the moisture repellency of the sealant. Although applicants do not intend to be bound by or to any particular theory, it is believed that at the concentrations preferably used in the Class One compositions, the silane is preferentially adsorbed onto the surface of the silica, displacing air and promoting wetting and dispersion of the silica. This has an insulating or further hydrophobizing effect on the silica surface and polar functional moieties in the polyester constituents. A suitable silane, (MPTS), can be obtained from Union Carbide Corporation, Danbury, Conn.

When the compositions of the present invention fall into Class Two, it is preferred that the compositions comprise more than about 85 percent on a weight basis of polyester and less than about 15 percent on a weight basis of silica. It is even more preferred that Class Two compositions comprise from about 85 percent to about 95 percent on a weight basis of polyester and from about 5 percent to about 15 percent of silica. The coupling and/or bridging agents described above are preferably included in Class Two compositions. The silane coupling agents are preferably present in the compositions in concentrations of from about 0.02 percent to about 0.5 percent on a weight basis, and even more preferably from about 0.1 to about 0.4 weight percent. The organic bridging agents are preferably contained in the composition in concentrations of from about 0.05 percent to about 1 percent on a weight basis, and even more preferably from about 0.1 percent to about 0.4 percent.

Many additional components may be included in the present sealant compositions. For example, from about 0.01 percent to about 0.2 percent of the composition of a fluorinated non-ionic surfactant may be included to help promote the dispersion of the fumed silica in the polymeric base. For Class One compositions, the concentration range is even more preferably 0.03 to about 0.07 weight percent. For Class Two compositions, the concentration is even more preferably less than about 0.1 weight percent. In general, applicants have found that a surfactant concentration of about 0.075 weight percent is the most preferred since this amount appears to have the optimum impact in terms of polyester surface tension depression. Fluorinated acrylate oligomer surfactants are generally preferred. Such fluorinated surfactants are available from Minnesota Mining and Manufacturing Co., St. Paul, Minn., under the trade names, Fluorad FC-430 and Fluorad FC-431.

The compositions of the present invention, especially Class Two compositions, also preferably include organic dispersing agents. A large number of organic dispersing agents are well known in the art and all are within the scope of the present invention. It is preferred, however, that the organic dispersing agents comprise acrylate polymers, and even more preferably copolymers containing moieties derived from lower alkyl ($C_2$–$C_{10}$) acrylates. For example, a preferred organic dispersant consists of a liquid acrylate copolymer derived from ethyl acrylate (EA) and 2-ethylhexyl acrylate (EHA). The EH/EHA copolymers of the present invention preferably have a molecular weight of from about 15,000 to about 35,000 and even more preferably from about 18,000 to about 27,000. It is also generally preferred that the EA:EHA molar ratio is from about 2:8 to about 6:4 and even more preferably from about 3:7 to about 1:1. An exemplary EA/EHA copolymer is sold by Monsanto Chemical Company, Saint Louis, Mo. under the trademark, "MODAFLOW".

Other additives that may be used in the sealant compositions to enhance durability and provide longer functional performance include antimicrobials, corrosion inhibitors and antioxidants. In a preferred embodiment, from about 1.0 percent to about 1.5 percent of the composition on a weight basis comprises 10,10'-oxybisphenoxarsine, as a fungicide and bactericide. This material is available from Ventron Division of Thiokol Corp., Danvers, Mass., under the trade name, "VINYZENE BP-5-2U".

From about 0.05 percent to 0.2 percent benzotriazole available, for example, from Sherwin Williams, Cleveland, Ohio, may also be added to the composition as a corrosion inhibitor for copper conductors. From about 0.04 percent to 0.6 percent of an antioxidant, tetrakis[methylene 3-(3',5'-di-tert-butyl-4'-hydroxyphenyl)propionate]methane, may also be added. The Code of Federal Regulations designates this compound as tetrakis[methylene(3,5-di-tert-butyl-4-hydroxyhydrocinnamate)]methane. Antioxidants of this type are available from Ciba-Geigy, Hawthorne, N.Y. The formulation of IRGANOX 1010 is disclosed in U.S. Pat. Nos. 3,285,855 and 3,644,482. There are numerous other antimicrobials, corrosion inhibitors and antioxidants available on the market, which will perform substantially the same function as the ones used herein.

According to certain embodiments of the present invention, the sealant composition is made by adding the silane, fluorinated surfactant and all of the desired optional additives to the polyester. The resulting mixture is then preferably heated to a temperature no greater than about 200° F. (93° C.) for approximately 15 minutes until all the added components are dissolved in the polymer. The silica is then added to the heated mixture. To ensure homogeneity, the mixture is heated and continuously stirred until the silica is uniformly dispersed.

The sealant materials of the present invention are generally characterized as being essentially chemically inert, optically clear, and non-corrosive to glass, metals and plastics. The materials are also expected to have a low toxicity to humans. The sealants are also generally compatible with plastics and plastics bonded to metal because they do not cause delamination of plastic articles or plastic laminates. In certain preferred embodiments, the sealant compositions of the present invention have a viscosity of from about 125 units to about 350 units as measured by ASTM D217 Standard Test Methods for Cone Penetration of Lubrication Grease. It is also generally preferred that the sealants have a slump test value of less than about 0.1 inch and even more preferably less than about 0.075 inch. The compositions also preferably have a 24 hour water vapor absorption at about room temperature and about 95% humidity of less than about 1.5 weight percent and even more preferably less than about 1 weight percent. According to certain embodiments of the present invention, the sealant has a refractive index of 1.465. It is also expected that the sealants are capable of withstanding temperature cycling from −25° to 100° C. without change or damage. The sealants, therefore, are suitable for protecting and coupling optical materials. It is to be understood that the U-shaped crimpable connector is used as a representative example only. The herein disclosed sealants may be used for sealing other open and closed barrel terminals. Furthermore, the physical properties of the present compositions make them suitable for optical uses such as environmentally protective optical fiber couplers, temporary optical cementing and sealing (caulking) of glass joints, temporary removable protective coatings, and low toxicity moisture barriers and patches.

The following examples illustrate the invention. They are not to be construed as limitations on the instant invention. All compositions are expressed as parts by weight except where specifically indicated otherwise.

Unless otherwise indicated below, the values of water absorption reported in the Examples which follow refer to water vapor absorption in weight percent after exposure for about 24 hours to about room temperature (70–80° F.) and about 95% humidity.

EXAMPLE 1

A batch of sealant was prepared using a high shear dual shaft mixer fitted with vacuum attachments and heating jacket. The following ingredients given in parts by weight (pbw) were charged to the mixer in the order shown: 326 pbw polymeric adipate polyester (PLASTOLEIN 9776), 4.4. pbw of a bactericide (VINYZENE BP-5-2U), 0.4 pbw of a corrosion inhibitor (CO- BRATEC 99), 2.0 pbw of an antioxidant (IRGANOX 1010), 0.08 pbw organofunctional silane "MPTS", and 0.13 pbw of a non-ionic fluorosurfactant (FLUORAD FC-430). The mixer was closed and heated to 180° F. (82.2° C.). Agitation was begun using a sweep arm setting of 40 rpm for 5 min. Sixty-six pbw of fully hydrophobized fumed silica (AEROSIL R-974) (particle size: 200 $m^2/g$) was charged to the mixer followed by closing the mixer and wetting out the fumed silica by stirring with a sweep arm setting of 25 rpm.

After all the fumed silica was visibly wetted, the pressure on the mixture was reduced to 29 inches of mercury less than ambient. The materials were mixed for 1 hr 15 min using a sweep arm setting of 25 rpm and a high speed disperser blade setting of 1,500 rpm.

A clear, homogeneous, well dispersed thixotropic sealant resulted with a viscosity of 230 units (0.1 mm) as measured by the ASTM D217 method for testing cone penetration of lubricating greases as described below. The material was discharged into a 55 gallon drum and retained for further characterization as shown in Example 2 below.

ASTM D217 is a standard test procedure entitled "Standard Test Methods for Cone Penetration of Lubricating Grease", adopted by the American Society for Testing and Materials (ASTM) and used throughout the materials industry to determine viscosities of lubricating greases. This procedure was used to determine the cone penetration at 25° C. (77° F.) of a sample of the sealant that had received only minimum disturbance in transferring the sample to a grease worker cup or other suitable container. The apparatus used was a penetrometer, which is designated to measure in tenths of a millimeter the depth to which a standard cone penetrates the sample. The penetrometer has an adjustable table to properly position the cone on the surface of the sample prior to releasing the cone. The standard cone used was made of magnesium with a detachable, hardened steel tip having a total weight of 102.5±0.1 g in accordance with specifications of the test. A quantity of the sealant material and the test sample container are brought to a temperature of 25±0.5° C. in a water or air bath. A sample of the material is transferred to the container and packed to eliminate air pockets. The sample in the container is leveled and placed on the penetrometer table. The apparatus is adjusted so that the tip of the cone just touches the surface of the sample. The cone shaft is then released and allowed to drop for 5.0 ±0.1 seconds. The amount of penetration is read from an indicator on the apparatus. In accordance with the procedure the values given are the average of three penetration tests per sample.

EXAMPLE 2

The physical properties of the sealant of example 1 were compared to an extensively used silicone sealant in current commerce. The resulting test values shown below illustrate the superior appearance, homogeneity (fineness of grind), and creep of the sealant.

| Property Measured | Example 1 Sealant | Silicone Sealant |
|---|---|---|
| Appearance | Clear transparent | White translucent |
| Cone Penetration (ASTM D217) (units are 0.1 mm) | 180–280 | 200–300 |
| Bleed @ 170° F. 24 hrs. | 0% | 0% |

-continued

| Property Measured | Example 1 Sealant | Silicone Sealant |
|---|---|---|
| Specific Gravity (g/ml) | 1.27 | 1.03 |
| Index of Refraction | 1.465 | 1.407 |
| Creep (Migration in work area) | None | Extensive (50') |
| Fineness of grind (ASTM D1210) (NS) | 8 | 1.5 |
| Slump test | 0.1 inch | 0.1 inch |
| Stringy rheology as measured by a modified ASTM Izod impact apparatus (inches) | .75–1.25 | .75–1.25 |

EXAMPLE 3

The effect of adding an organofunctional silane coupling agent to a hydrophobic sealant was studied with respect to improvement of water repellency. Silane levels of 0%, 0.02%, 0.04%, 0.08%, 0.16% and 0.32%, based on the weight of the sealant, were used. The moisture sorption of these materials in a 95 percent relative humidity cabinet was tested at 15 days, 30 days and 42 days using the water determination method known to those skilled in the art as the Karl Fisher titration.

Silane levels of 0.02 to 0.04% proved to be the most effective yielding moisture sorption levels when (MPTS) was used as the additive. The results are represented in the table below.

| Sample | Moisture Sorption/Time 15 days | 30 days | 42 days |
|---|---|---|---|
| 0% Silane | 2.0% | 2.33% | 2.46% |
| .02% Silane | 2.4% | 2.33% | 2.21% |
| .04% Silane | 2.2% | 1.92% | 2.36% |
| .08% Silane | 2.4% | 2.48% | 3.07% |
| .16% Silane | 2.2% | 2.95% | 2.85% |
| .32% Silane | 2.2% | 2.7% | 3.23% |

EXAMPLE 4

A sealant composition according to the present invention was prepared using a high shear dual shaft mixer fitted with vacuum attachments and heating jacket. The following ingredients given in parts by weight (pbw) were charged to the mixer in the order shown: 89.2 pbw polymeric adipate polyester (PLASTOLEIN 9776), 1.1 pbw of a bactericide, 0.1 pbw of a corrosion inhibitor (COBRATEC 99), 0.5 pbw of an antioxidant (IRGANOX 1010), 0.03 pbw epoxy functional silane (G6720), 2.1 pbw of an acrylate copolymer (MODAFLOW), and 0.075 pbw of a non-ionic fluorosurfactant (FLUORAD FC-430). The mixer was closed and heated to 180° F. (82.2° C.). Agitation of the material contained in the mixer was begun using a sweep arm setting of 40 rpm for 5 min. Eight pbw of hydrophilic fumed silica (AEROSIL 200) (particle size: 200 $m^2/g$) was then charged to the mixer followed by closing the mixer and wetting out the fumed silica by stirring with a sweep arm setting of 25 rpm.

After all the fumed silica was visibly wetted, the pressure on the mixture was reduced to 29 inches of mercury less than ambient. The materials were then mixed for an additional 1 hr 15 min using a sweep arm setting of 25 rpm and a high speed disperser blade setting of 1,500 rpm. 0.325 pbw of TEA was then charged to the mixer. The contents of the mixer were then stirred for an additional 15 minutes to produce a clear, homogeneous, well dispersed thixotropic sealant composition having a viscosity at 74° F. of about 143 units (0.1 mm) as measured by the ASTM D217 method described in Example 1.

The physical properties of the sealant composition of this Example were found to be as follows:

| Property Measured | |
|---|---|
| Appearance | Clear transparent |
| Cone Penetration (ASTM D217) (units are 0.1 mm) | 143 |
| Bleed @ 170° F. 24 hrs. | 0 |
| Specific Gravity (G/ml) | 1.27 |
| Index of Refraction | 1.4 |
| Creep (Migration in work area) | None |
| Fineness of grind (ASTM D1210) (NS) | 8 |
| Slump test | 0.05 inch |
| Stringy rheology as measured by a modified ASTM Izod impact apparatus (inches) | 0.3 inch |

The heat stability of the composition was analyzed by subjecting the composition to each of the following temperatures for sequential 24 hour periods: 104° F., 140° F., 185° F. and 76° F. The viscosity of the composition was measured at the close of each 24 hour period and was found to be 148 at the end of the 104° F. period, 147 at the end of the 140° F. period, 150 at the end of the 185° F. period and 145 at the end of the 76° F. period, all viscosities as measured by ASTM D217. No visible change in appearance of the composition was observed.

The composition was also found to have a water vapor absorption of 1.15 percent by weight after being exposed for 10 days to 104° F. temperature and 95% relative humidity.

A comparison of Examples 1, 2 and 3 with Example 4 reveals the superior viscosity and rheology characteristics of the composition disclosed in this Example. In addition, the water repellent characteristics of the compositions of Example 1 and Example 4 appear to be comparable. Moreover, the polyester:silica weight ratio of the Example 4 composition, i.e., 11.1, is much larger than the ratio of the composition of Example 1, i.e., 4.9, thus reflecting the relative savings in material cost for the composition of Example 4.

EXAMPLE 5

A sealant composition was produced by the method disclosed in Example 4 except that hexamethyldisilazane was added to the mixture in an amount of about 0.3 pbw in place of the epoxy functional silane. The composition was found to have a ASTM D217 viscosity value at 74° F. of about 232 units. The composition of this Example was also found to have a slump test value of 0.05 inch, a string test value of 0.4 inch and a water vapor absorption of about 1.2 weight percent.

EXAMPLE 6

A sealant composition was made according to the method described in Example 4 except: a hydrophilic silica sold under the tradename Cab-O-Sil M-5 by the Cabot Corp. was substituted on an equivalent weight basis for the silica of Example 4; and hexamethyldisilizane was added to the mixture in an amount of about 0.3 pbw in place of the epoxy functional silane.

After analysis, the ASTM D217 viscosity of the composition at room temperature (74° F.) was found to be 176 units, the slump test value was found to be 0.05 inch, and the string test value was found to be 0.3 inch. The water absorption rate of the composition was found to be about 1.3 weight percent.

EXAMPLE 7

15 pbw of a hydrophilic precipitated silica (AEROSIL 200) having a particle surface area of 200 square meters per gram (as determined by a B-E-T nitrogen test) was dispersed by stirring at room temperature in 85 pbw of the polymeric adipate polyester (PLASTOLEIN 9776) used in Example 4 to form a sealant composition. The composition was analyzed and found to have an ASTM D217 viscosity of about 180–220.

EXAMPLE 8

1 pbw of TEA was added to 99 pbw of the composition described in Example 7 by stirring at room temperature. The material was stored overnight at a 140° F. to form a sealant composition. The sealant composition was subsequently tested and found to have an ASTM D217 viscosity at 74° F. of about 140–170 units. A comparison of Example 7 and reveals the improvement in viscosity characteristics which results when an organic bridging agent is included in the sealant compositions.

EXAMPLE 9

A sealant composition was prepared by the methods disclosed in Example 1 except that 13.5 percent by weight of the sealant composition of fully hydrophobized fumed silica (AEROSIL R-974) was added to the mixer rather than the 16.5 percent by weight disclosed in Example 1. After testing, the composition was found to have the following properties: an ASTM D217 viscosity at 74° F. of about 200–220 units; a slump test value of about 0.05; a string test value of about 0.3; and water absorption of about 0.85%.

EXAMPLE 10

A sealant composition was prepared by the methods disclosed in Example 9 except that 9.6 percent by weight of the sealant composition of fully hydrophobized fumed silica (AEROSIL R-974) was added to the mixer instead of the 16.5 percent by weight added in Example 1. The resulting sealant composition was analyzed and found to have an ASTM D217 viscosity at 74° F. of greater than about 300.

EXAMPLE 11

99 pbw of the sealant composition described in Example 9 was mixed with 1 pbw of triethanolamine (TEA) by stirring at room temperature. The resulting sealant composition was stored overnight at 140° F. The composition was analyzed and found to have the following properties: an ASTM D217 viscosity at 74° F. of less than about 150 units.

EXAMPLE 12

99 pbw of the composition described in Example 10 was mixed with 1 pbw of TEA by stirring at room temperature. The composition was stored overnight at 140° F. The resulting sealant composition was analyzed and found to have an ASTM D217 viscosity at 74° F. of about 180–200 units.

EXAMPLE 13

84.4 pbw of polymeric adipic polyester (PLASTOLEIN 9776), 5 pbw of an acrylate copolymer dispersant, 0.5 pbw of hexamethyldisilazane, and 0.1 pbw of a non-ionic fluoro surfactant (FLUORAD FC-430) were mixed according to the procedure described in Example 4 until the mixture was visibly homogeneous at room temperature. 10 pbw of a hydrophilic fumed silica (AEROSIL 200) was dispersed in the homogeneous mixture by stirring at room temperature, the fumed silica being added in five separate increments of 2 pbw each. Each increment was added after homogeneous dispersion of the previously added increment was observed. The composition was heated so as to raise the temperature of the mixture to about 140° F. for one hour, whereupon it was remixed without heating for 2 additional hours. This process of heating and remixing was repeated an additional two times.

It was observed that the mixing process was easier and more rapid that the process used to produce the sealing composition of Example 1. The composition was analyzed and found the have an ASTM D217 viscosity at 74° F. of about 150–180 units.

EXAMPLE 14

90 pbw of a polymeric polyester derived from adipic acid sold under the tradename "PARAPLEX G-57", is mixed with 10 pbw of an unhydrophobized fumed silica sold under the tradename "AEROSIL 200" by stirring at room temperature for one hour. Non dispersed lumps of silica gel are observed to remain in the mixture after one hour of stirring at room temperature.

EXAMPLE 15

The procedure described in Example 14 is repeated except that 0.1 pbw of a fluorinated acrylate oligomer sold under the tradename "FLUORAD FC-430" is added to the mixture by stirring. The stirring is observed to facilitated, with little or no lumps of silica gel remaining undispersed.

EXAMPLE 16

Five batches of a composition consisting of a polymeric polyester sold under the tradename "PLASTOLEIN 9776" and varying amounts of the fluorinated surfactant "FLUORAD FC-430" were produced by stirring the mixtures thoroughly for 15 minutes at room temperature and then storing at room temperature for 24 hours. The amount of the fluorinated surfactant and the surface tension as measured by a Du Nuoy Tensiomrter of each composition is described below:

| Fluorinated Surfactant, pbw | Surface tension, dynes/cm |
|---|---|
| 0 | 37.7 |
| 0.025 | 36.0 |
| 0.05 | 36.2 |
| 0.075 | 35.8 |
| 0.1 | 35.1 |

EXAMPLE 17

Utilizing the procedure described in Example 4, the composition described below was produced:

| Component | PBW |
|---|---|
| Polymeric polyester (PLASTOLEIN 9776) | 87.625 |
| Fluorosurfactant (FLUORAD FC-430) | 0.075 |
| Preservative (VINYZENE BP-5-2U) | 1.1 |
| Antioxidant (IRGANOX 1010) | 0.5 |
| Benxotriazole (COBRATEC 99) | 0.1 |
| Silane (G6720) | 0.3 |
| TEA | 0.2 |
| Dispersant (MODAFLOW) | 2.1 |
| Silica (AEROSIL 200) | 8.0 |
| | 100 |

The composition described above is a clear, essentially water white, homogeneous sealant gel having the following properties:

| Property Measured | |
|---|---|
| Appearance | Clear transparent |
| Cone Penetration (ASTM D217) (units are 0.1 mm) | 170 |
| Bleed @ 170 ° F. 24 hrs. | 0 |
| Specific Gravity (G/ml) | 1.2 |
| Index of Refraction | 1.46 |
| Creep (Migration in work area) | None |
| Fineness of grind (ASTM D1210) (NS) | 8 |
| Slump test | 0.05 |
| Stringy rheology as measured by a modified ASTM Izod impact apparatus (inches) | 0.1 |
| Water Vapor Absorption (24 hr. at 104° F.) | 0.6% |

EXAMPLE 18

A batch of sealant composition hereinafter designated as Sealant A for convenience, was prepared according to the methods generally described in Example 5 by mixing 2.1 pbw of "FLUORORAD FC-430" fluorosurfactant, 56 pbw of "MODAFLOW" dispersant, 2,512 pbw of "PLASTOLEIN 9776" polymeric polyester and 224 pbw of "AEROSIL 200" hydrophilic silica to produce a rough dispersion The rough dispersion was then heated for one hour in an 85° C. oven and homogenized. The homogenized material was then deaerated at a temperature of 85° C. and a pressure of less than about 10 mm mercury absolute for about 2 hours. A light straw colored transparent gel herein designated as Sealant A resulted.

99.8 pbw of Sealant A was then separately mixed by stirring with about 0.2 pbw of various organic bridging agents. The mixtures were then homogenized and deaerated as described above. The particular bridging agents used and the properties of the gel-like sealants which resulted are described in the table which follows:

| Bridging Agent | ASTM D217 Viscosity | String Test, Inch | Water Vapor Absorption |
|---|---|---|---|
| None (Sealant A) | 206 | 0.38 | 0.8 |
| TEA | 136 | 0.35 | 0.6 |
| Propylene Glycol | 186 | 0.4 | 0.7 |
| Trimethylolpropane | 197 | 0.46 | 0.7 |

Sealant A was also separately mixed with varying amounts of TEA, and then homogenized and deaerated as described above. The particular TEA concentrations and the properties of the gel-like sealant which resulted are described in the table which follows:

| TEA, wt % | ASTM D217 Viscosity | String Test, Inch | Water Vapor Absorption |
|---|---|---|---|
| 0 | 206 | 0.38 | 0.8 |
| 0.1 | 174 | 0.42 | — |
| 0.2 | 166 | 0.35 | 0.6 |
| 0.5 | 173 | 0.44 | 0.6 |
| 0.75 | 170 | 0.46 | 0.6 |
| 1.0 | 180 | 0.42 | 0.8 |

EXAMPLE 19

The sealing composition of Example 9 was utilized to produce a moisture-proof connector using a connector of the type described in U.S. Pat. No. 3,410,950-Freudenberg. 0.2 grams of the sealant composition were dispensed to each end of the connector body between the wire receiving projections. A first transmission means, i.e., U.S. wire gauge No. 19, was placed at one end of the connector and a second wire of the same gauge was placed at the other end of the connector. The connector was then crimped to splice the wires. After crimping, the excess sealant was wiped from the outside of the connector body. The connector splice was then immersed under about 2 inches of water at about 74° F. for about 24 hours. The connector splice was then removed from the water and examined under 10 power magnification. No water penetration to the sealed sections of the connector was observed, and no sealant was observed to have been extracted from the connector.

The connector was reimmersed under about 2 inches of water at 140° F. for about 24 hours. The connector splice was again removed from the water and examined under 10 power magnification. No extraction or water penetration of the sealed sections was observed, although whitening of the sealant at the ends of the connector was noted.

What is claimed is:

1. A moisture-proof electrical connector for sealingly connecting transmission means therein comprising
   (a) a connector body having a receiving means for accepting and receiving a transmission means; and
   (b) a sealant composition disposed along or adjacent to the receiving means, said sealant composition comprising:
      (i) polymeric adipic acid polyester in an amount at least about 50% by weight of the composition;
      (ii) silica thickening agent dispersed in said polymer;
      (iii) organofunctional coupling agent; and
      (iv) polyfunctional bridging agent, said silica thickening agent and said coupling and said bridging agents being present in amounts sufficient to cause gelation of said composition.

2. The connector of claim 1 wherein said composition has a viscosity of from about 125 units to about 350 units of 0.1 mm each as measured by ASTM D217 Standard Test Methods for Cone Penetration of Lubricating Grease.

3. The connector of claim 1 wherein:
   (a) the concentration of said polyester is from about 80% to about 95% by weight of the composition;
   (b) said silica thickening agent comprises a hydrophilic fumed silica in an amount at least 50% by weight of the silica; and
   (c) the concentration of said silica thickening agent is from about 5% to about 15% by weight of the composition.

4. The connector of claim 3 wherein said organofunctional coupling agent is selected from the group consisting of (glycodioxypropyl)trimethoxysilane, hexamethyldisilizane, (methacryloxypropyl)trimethoxysilane, (epoxycyclohexyl)-ethyltrimethoxysilane and mixtures of these.

5. The connector of claim 4 wherein said coupling agent comprises (glycodioxypropyl)trimethoxysilane in an amount from about 0.1% to about 0.4% by weight of the composition and said bridging agent comprises triethanolamine in an amount from about 0.2% to about 0.4% by weight of the composition.

6. The connector of claim 3 wherein said polyfunctional bridging agent is selected from the group consisting of ethylene glycol, pentaerythritol, trimethylolpropane, triethanolamine, and mixtures of these.

7. A moisture-proof electrical connector for sealing leak connecting transmission means therein comprising:
   (a) a connector body having a receiving means for accepting and receiving a transmission means; and
   (b) a sealant composition having a viscosity of from about 125 units to about 350 units of 0.1 mm each as measured by ASTM D217 Standard Test Methods for Cone Penetration of Lubricating Grease disposed along or adjacent to the receiving means, said sealant composition comprising:
      (i) polymeric adipic acid polyester in an amount from about 80% to about 88% by weight of the composition;
      (ii) fully hydrophobized silica thickening agent dispersed in said polymer in an amount from about 12% to about 18% by weight of the composition;
      (iii) organofunctional coupling agent; and
      (iv) polyfunctional bridging agent, said silica thickening agent and said coupling and said bridging agents being present in amounts sufficient to cause gelation of said composition.

8. The connector of claim 7 wherein said composition has a viscosity of from about 180 units to about 280 units of 0.1 mm each as measured by ASTM D217 Standard Test Methods for Cone Penetration of Lubricating Grease.

9. The connector of claim 7 wherein:
   (a) said polyester has an average molecular weight as calculated from solution viscosity measurements of from about 1,000 to about 8,000 and comprises the reaction product of adipic acid and a lower alkylene glycol; and
   (b) said silica thickening agent comprises a fully hydrophobized fumed silica.

10. The connector of claim 9 wherein said lower alkylene glycol is butylene glycol.

11. The connector of claim 9 wherein said organofunctional coupling agent is selected from the group consisting of (glycodioxypropyl)trimethoxysilane, hexamethyldisilizane, (methacryloxypropyl)trimethoxysilane, (epoxycyclohexyl)-ethyltrimethoxysilane and mixtures of these.

12. The connector of claim 9 wherein said polyfunctional bridging agent is selected from the group consisting of ethylene glycol, pentaerythritol, trimethylolpropane, triethanolamine, and mixtures of these.

13. The connector of claim 9 wherein said coupling agent comprises (glycodioxypropyl)trimethoxysilane in an amount from about 0.02% to about 0.5% by weight of the composition and said bridging agent comprises triethanolamine in an amount from about 0.05% to about 1.0% by weight of the composition.

14. A moisture-proof electrical connector for sealingly connecting transmission means therein comprising:

(a) a connector body having a receiving means for accepting and receiving a transmission means; and (b) a sealant composition having a viscosity of from about 125 units to about 350 units of 0.1 mm each as measured by ASTM D217 Standard Test Methods for Cone Penetration of Lubricating Grease disposed along or adjacent to the receiving means, said sealant composition comprising:

(i) polymeric adipic acid polyester in an amount from about 85% to about 95% by weight of the composition;

(ii) hydrophilic silica thickening agent dispersed in said polymer in an amount from about 5% to about 15% by weight of the composition;

(iii) organofunctional coupling agent; and (iv) polyfunctional bridging agent, said silica thickening agent and said coupling and said bridging agents being present in amounts sufficient to cause gelation of said composition.

15. The connector of claim 14 wherein said composition has a viscosity of from about 180 units to about 280 units of 0.1 mm each as measured by ASTM D217 Standard Test Methods for Cone Penetration of Lubricating Grease.

16. The connector of claim 14 wherein:

(a) said polyester has an average molecular weight as calculated from solution viscosity measurements of from about 1,000 to about 8,000 and comprises the reaction product of adipic acid and a lower alkylene glycol; and (b) said silica thickening agent comprises fumed silica.

17. The connector of claim 16 wherein said lower alkylene glycol is butylene glycol.

18. The connector of claim 14 wherein said organofunctional coupling agent is selected from the group consisting of (glycodioxypropyl)trimethoxysilane, hexamethyldisilizane, (methacryloxypropyl)trimethoxysilane, (epoxycyclohexyl)-ethyltrimethoxysilane and mixtures of these.

19. The connector of claim 14 wherein said polyfunctional bridging agent is selected from the group consisting of ethylene glycol, pentaerythritol, trimethylolpropane, triethanolamine, and mixtures of these.

20. The connector of claim 14 wherein said coupling agent comprises (glycodioxypropyl)trimethoxysilane in an amount from about 0.02% to about 0.5% by weight of the composition and said bridging agent comprises triethanolamine in an amount from about 0.05% to about 1.0% by weight of the composition.

* * * * *